US012709451B2

(12) United States Patent
Sadowski

(10) Patent No.: US 12,709,451 B2
(45) Date of Patent: Aug. 18, 2026

(54) CONTAINER FOR DISPOSABLE MOISTURE ABSORBING ARTICLE

(71) Applicant: Henry J. Sadowski, Little River, SC (US)

(72) Inventor: Henry J. Sadowski, Little River, SC (US)

( * ) Notice: Subject to any disclaimer, the term of this patent is extended or adjusted under 35 U.S.C. 154(b) by 23 days.

(21) Appl. No.: 18/961,649

(22) Filed: Nov. 27, 2024

(65) Prior Publication Data

US 2026/0145860 A1 May 28, 2026

(51) Int. Cl.
*B65D 81/26* (2006.01)
*B65D 45/34* (2006.01)

(52) U.S. Cl.
CPC ..... *B65D 81/264* (2013.01); *B65D 45/34* (2013.01)

(58) Field of Classification Search
CPC ..... B65D 81/264; B65D 45/34
USPC ..... 206/204
See application file for complete search history.

(56) References Cited

U.S. PATENT DOCUMENTS 5,907,908 A 6/1999 Cunanan et al.
6,325,245 B1 * 12/2001 Matthews ..... A47K 5/12 222/181.3
6,767,521 B1 7/2004 Vogt et al.
7,377,958 B2 5/2008 Cunanan
10,427,087 B2 10/2019 Willert
11,780,075 B2 * 10/2023 Barton ..... A45C 13/02 206/372
2005/0045522 A1 * 3/2005 Corcoran ..... B65D 21/0223 206/561
2005/0098450 A1 5/2005 Liu
2014/0360374 A1 12/2014 Hatfield

FOREIGN PATENT DOCUMENTS

JP 2019/188359 A 10/2019
WO PCT/US2018/026834 A1 10/2018

OTHER PUBLICATIONS

Novo Black Manual Foam Hand Soap / Sanitizer Dispenser 33.8 fl. oz. (1000 mL). (2022). WebstaurantStore. https://www.webstaurantstore.com/noble-chemical-novo-pro-series-black-manual-foam-hand-soap-sanitizer-dispenser-1-000-ml/147NFMNDSPBK.html (Year: 2023).*

* cited by examiner

*Primary Examiner* — Chun Hoi Cheung
*Assistant Examiner* — Sanjidul Islam
(74) *Attorney, Agent, or Firm* — P. Jeff Martin; The Law Firm of P. Jeffrey Martin, LLC

(57) ABSTRACT

A container for securely supporting a commercially-available moisture absorbing article within an interior storage volume of the container.

7 Claims, 12 Drawing Sheets

CONTAINER FOR DISPOSABLE MOISTURE ABSORBING ARTICLE

I. RELATED APPLICATIONS

There are no currently pending applications anywhere in the world.

II. FIELD OF THE INVENTION

The present application discloses and describes a container, and more particularly, a container sized, shaped, and configured to dimensionally accommodate a disposable moisture absorbing article in a snug, size complementary-fit manner.

III. BACKGROUND OF THE INVENTION

A number of dehumidifier systems and apparatuses are disclosed in the prior art. Although not an exhaustive itemization of those efforts, the following is a representation of the various devices and systems that have been developed:

- U.S. Pat. No. 6,767,521 B1, issued in the name of Vogt et al.;
- U.S. Pat. No. 10,427,087 B2, issued in the name of Willert;
- U.S. Pat. No. 5,907,908, issued in the name of Cunanan et al.;
- U.S. Pat. No. 7,377,958 B2, issued in the name of Cunanan;
- International Application No. WO2018/191230 A1, published in the name of Groover et al.;
- U.S. Patent Publication No. 2014/0360374 A1, published in the name of Hatfield;
- U.S. Patent Publication No. 2005/0098450 A1, published in the name of Liu; and
- Japanese Patent Publication No. 2019/188359 A, published in the name of Yuko, Takai.

Accordingly, there is a need for a container sized, shaped, and configured to dimensionally accommodate a disposable moisture absorbing article in a snug, size complementary-fit manner.

This application presents claims and embodiments that fulfill a need or needs not yet satisfied by the products, inventions, systems, and methods previously or presently available. In particular, the claims and embodiments disclosed herein describe a container for an article, the container comprises a top wall opposing a bottom wall; a first vertical wall opposing a second vertical wall; a rear wall; a front door pivotally secured between the first vertical wall and the second vertical wall; an interior storage volume dimensionally configured to accommodate a disposable moisture absorbing article in a snug, size complementary-fit manner; and a means for releasably securing the front door in a closed, locked position, the container providing unanticipated and nonobvious combination of features distinguished from the products, devices, apparatuses, inventions, systems, and methods preexisting in the art. The applicant is unaware of any device, apparatus, method, system disclosure or reference that discloses the features of the claims and embodiments disclosed herein.

IV. SUMMARY OF THE INVENTION

Generally, according to a broadly described embodiment, a container for a moisture absorbing article is disclosed. The container comprises a top wall opposing a bottom wall, a first vertical wall opposing a second vertical wall, and a rear wall.

An article suspension post is mounted to the rear wall. The post provides a support means on which a commercially-available moisture absorbing article may be hung, thereby supporting the article in an immobilized, vertically-suspended manner.

The container further comprises a front door pivotally secured between the first vertical wall and the second vertical wall. The front door comprises a T-shaped configuration.

A means for releasably securing, or otherwise fastening or locking, the front door in a closed position is disclosed. The means for releasably securing the door in a closed position may include a toggle latch. When the front door is placed in a closed, locked position, the container provides an interior storage volume dimensionally configured to accommodate the disposable moisture absorbing article in a snug, size complementary-fit manner.

In accordance to another embodiment, the container may may comprise mounting hardware on the rear surface of the rear wall to enable the container to be securably hung on a vertical surface.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

Figure 7:
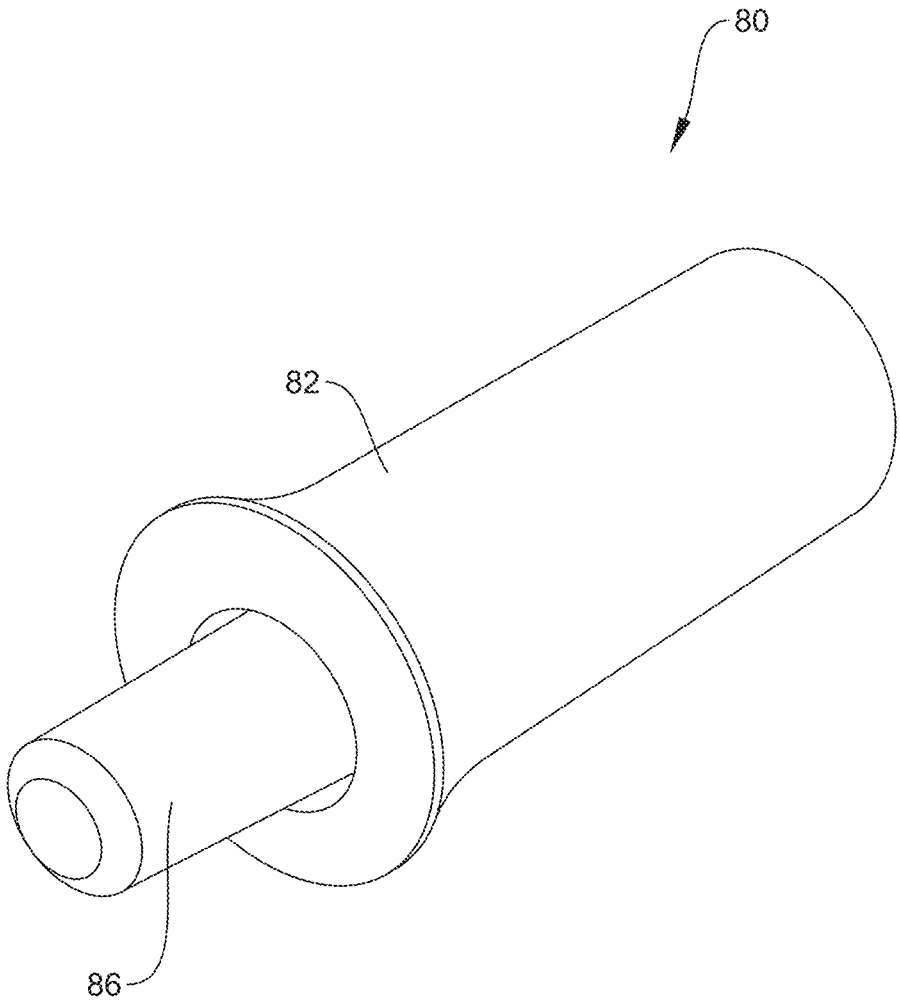
FIG. 7 is a perspective view of a spring-loaded pin, in accordance to one embodiment of the present invention.
Figure 7A:
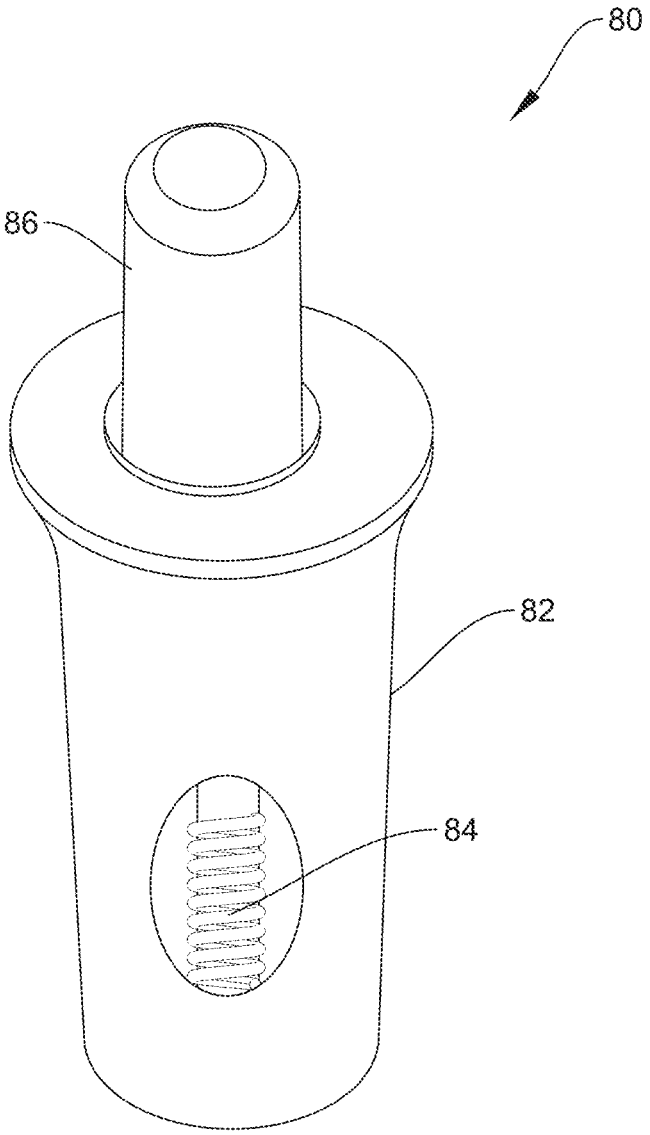
Figure 8:
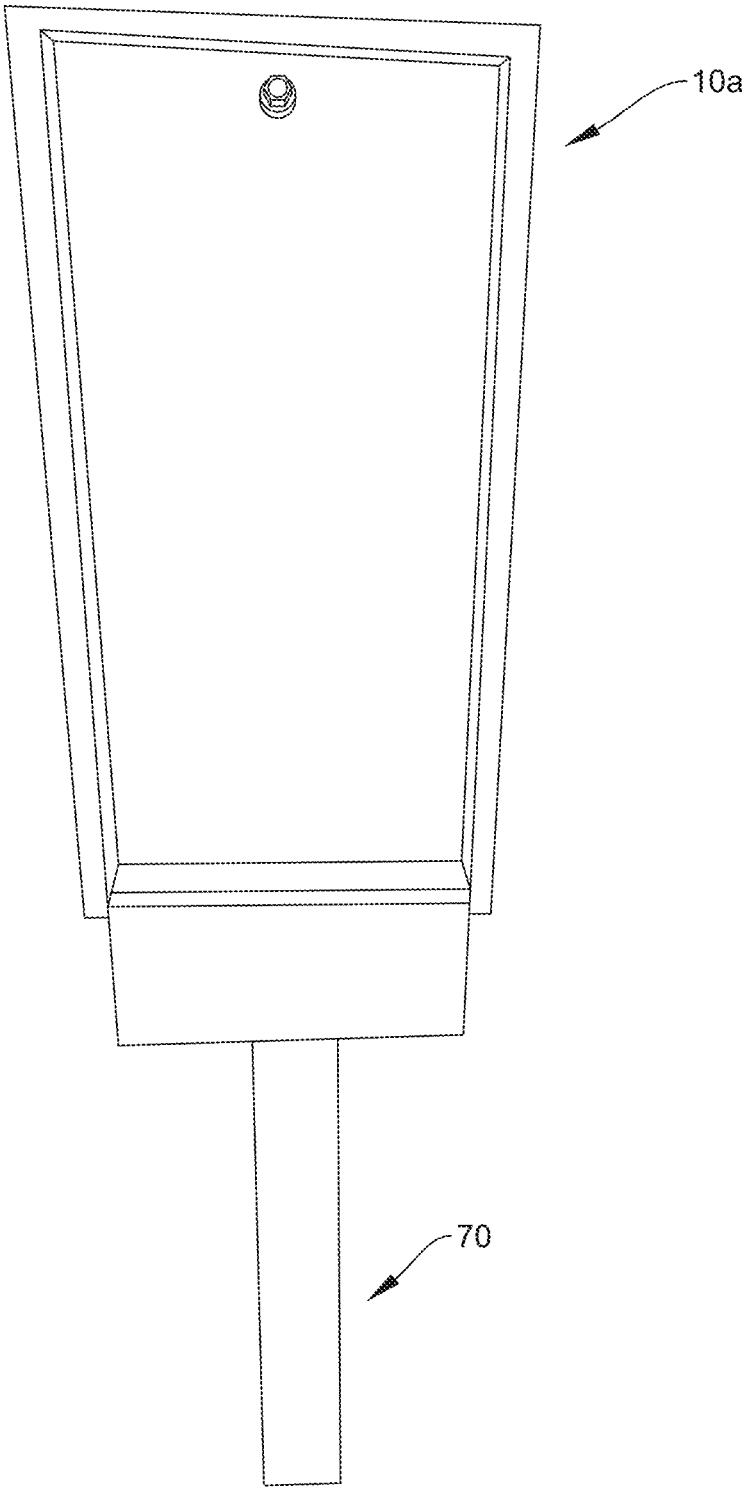
Figure 9:
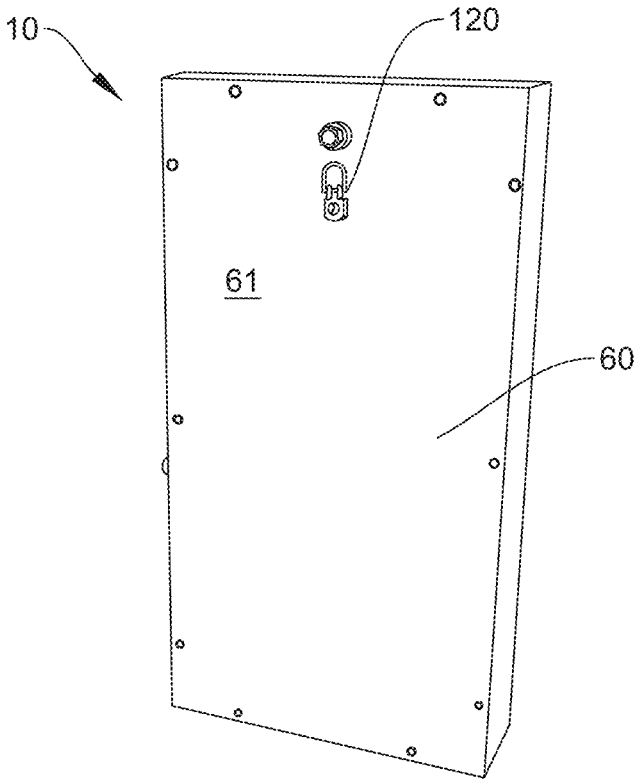
Figure 9A:
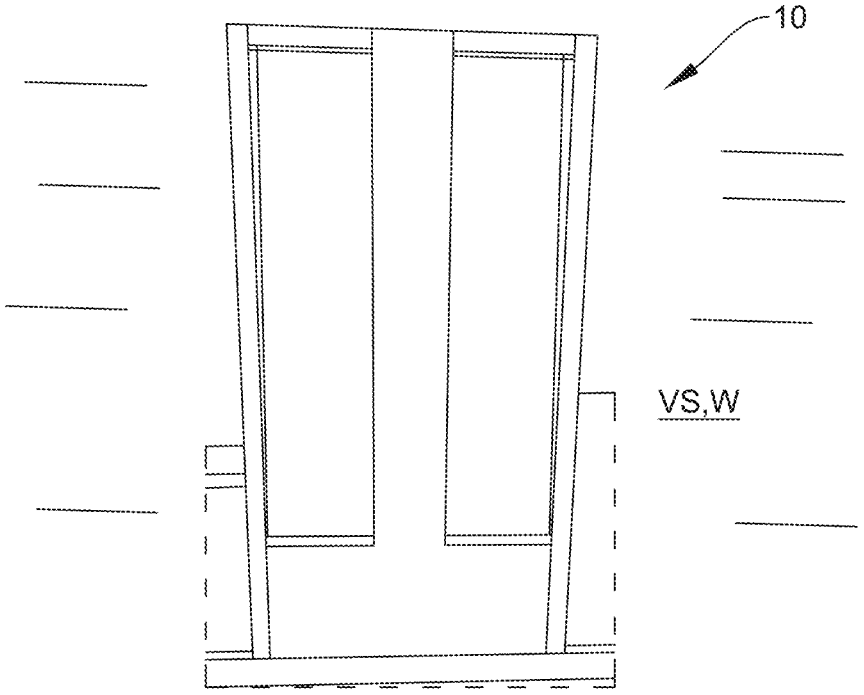
Figure 10:
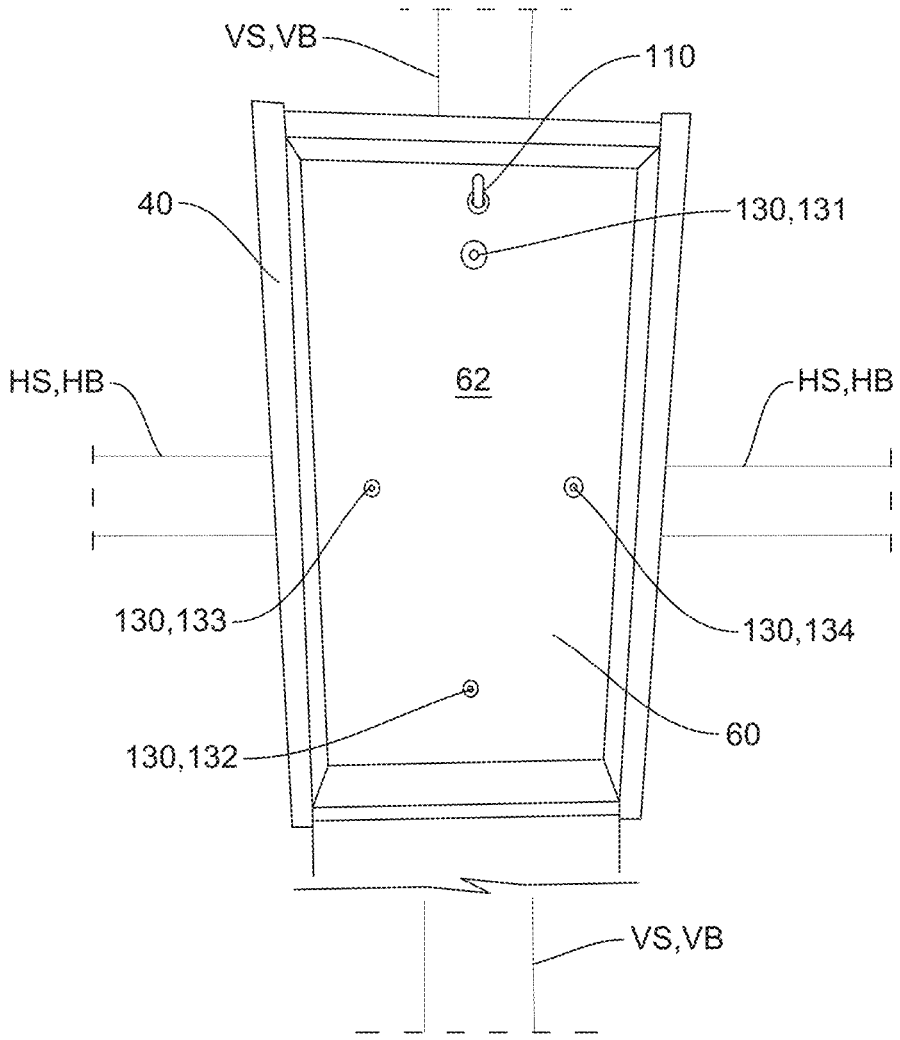
Figure 10B:
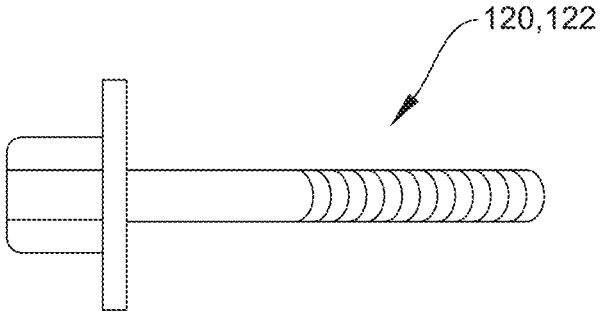
Figure 10A:
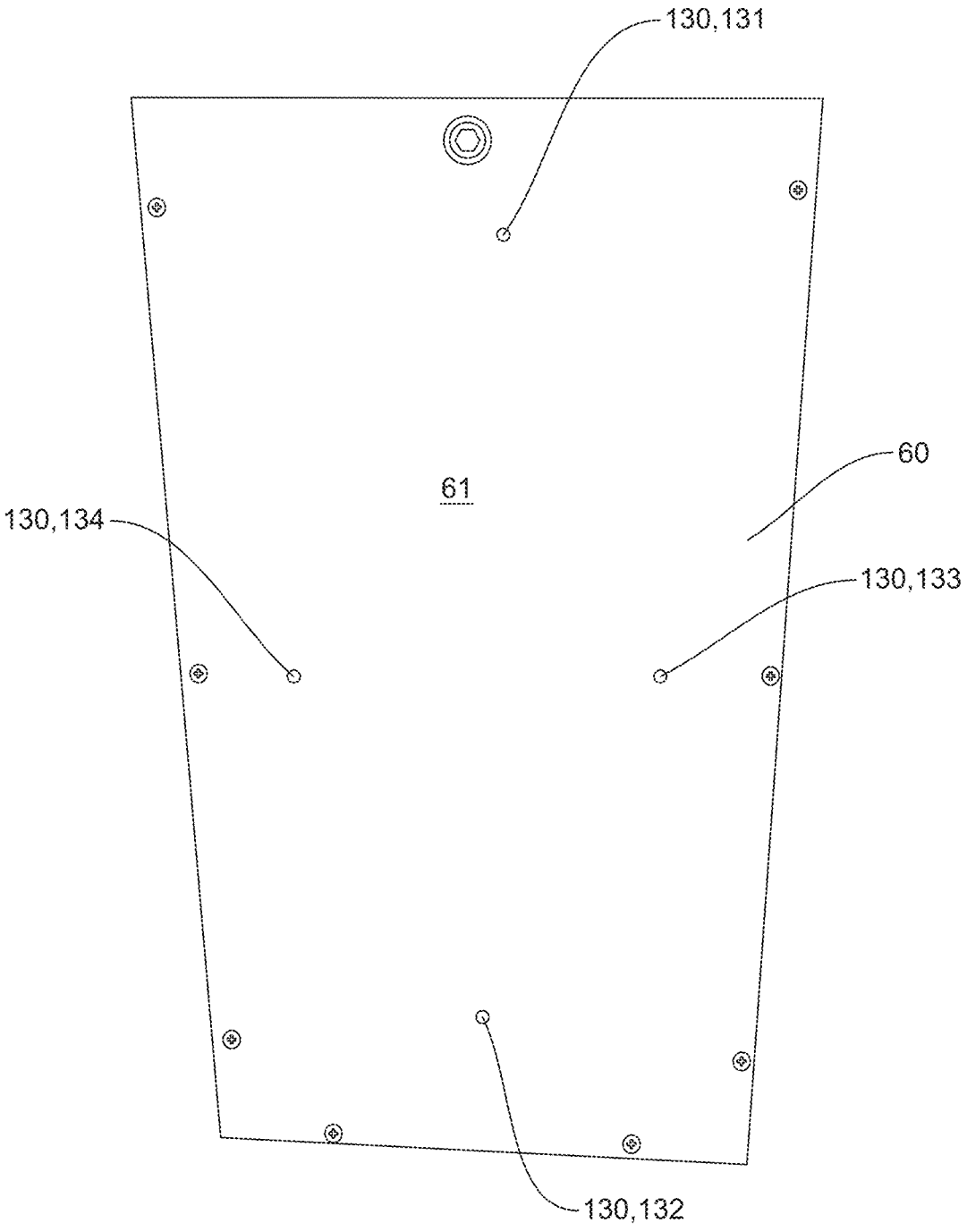

FIG. 7*a* is a partial sectional view of the body of the pin illustrated in FIG. 7 depicting the spring encapsulated therein;

FIG. 8 is a front elevational view of a single-mold container constructed using a common molding process, in accordance to another embodiment of the present invention;

FIG. 9 is a right, rear elevational view of the container illustrating mounting hardware, in accordance to another embodiment of the present invention;

FIG. 9*a* is a front elevational view of the container of FIG. 9 shown mounted to a wall;

FIG. 10 is a front elevational view of the container illustrating a plurality of recessed apertures, wherein the front door is depicted partially in a fully opened position, in accordance to another embodiment of the present invention;

FIG. 10*a* is a rear elevational view of the container of FIG. 10; and

FIG. 10*b* is a perspective view of mounting hardware, shown therein as a bolt and washer.

VI. DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

According to at least one embodiment, and consistent with FIGS. 1-7*a*, a container for a moisture absorbing article is generally denoted by the reference character 10. Consistent with the figures, the container for a moisture absorbing article 10, hereinafter, "container 10", is sized, shaped, and configured to dimensionally accommodate a disposable moisture absorbing article 5 (e.g., a commercially-available moisture absorbing pouch 6 or bag) in a snug, size complementary-fit manner, thereby immobilizing or maintaining the article 5 in a suspended, stationary position while the article 5 is positioned in the container 10, and thus preventing leaking and spillage of the contents 8 from the article 5. In accordance to one embodiment, the commercially-available moisture absorbing pouch 6 or bag comprises a moisture absorbing pouch 7, such as the those sold under the registered trademarks, "DampRid®" and "ARM & HAMMER®". For purposes of this disclosure, the terms "snug", "snug-fit", and "snugly" are each defined as a substantially-intimate, close-fitting relationship.

The container 10 comprises a top wall 20 opposing a bottom wall 30, a first vertical wall 40 opposing a second vertical wall 50, and a rear wall 60. The top wall 20 is mounted orthogonally between upper end inner surfaces 42 and 52 of the first vertical wall 40 and second vertical wall 50. The top wall 20, the first vertical wall 40, and the second vertical wall 50 are mounted perpendicularly to a peripheral inner edge of the rear wall 60. The top wall 20 may be mounted between the first vertical wall 40 and the second vertical wall 50, and to the rear wall 60 via fasteners 12, such as screws 13. The bottom wall 30 is mounted orthogonally between lower end inner surfaces 44 and 54 of the first vertical wall 40 and second vertical wall 50, respectively. The bottom wall 30, the first vertical wall 40, and the second vertical wall 50 are mounted perpendicularly to the peripheral inner edge of the rear wall 60. The bottom wall 30 may be mounted between the first vertical wall 40 and the second vertical wall 50, and to the rear wall 60 via fasteners 12, such as screws 13. The top wall 20 is contiguous to the first and second vertical walls 40 and 50, and the rear wall 60, and the bottom wall 30 is contiguous to the first and second vertical walls 40 and 50, and the rear wall 60. The rear wall 60 includes a front surface 62 opposing a rear surface 61.

In accordance to another embodiment, it is envisioned the top wall 20, bottom wall 30, first vertical wall 40, second vertical wall 50, and rear wall 60 may be integrally molded forming a unitary container 10*a*. Particularly, the top wall 20, bottom wall 30, first vertical wall 40, second vertical wall 50, and rear wall 60 may be constructed utilizing a common molding process such as injection molding, blow molding, extrusion, or other molding and fabricating methods so as to form a single or unitary container mold 10*a* (shown in FIG. 8).

The container 10 further comprises a front door 70 pivotally secured between the first vertical wall 40 and the second vertical wall 50. The front door 70 comprises a T-shaped configuration having a horizontal lower panel 72 and an elongated, narrow arm 76 integrally projecting from the lower panel 72 about a centerline CL thereof. The T-shaped configuration of the door 70 provides enlarged openings 70*a*, 70*b* on opposed sides of the narrow arm 76.

The front door 70 is pivotally secured between the first vertical wall 40 and the second vertical wall 50 via a pair of spring-loaded pins 80. Each of the spring-loaded pins 80 comprises a body 82 encapsulating a spring 84, and a piston 86 biased outwardly in a resting position by the spring 84.

Figure 1:
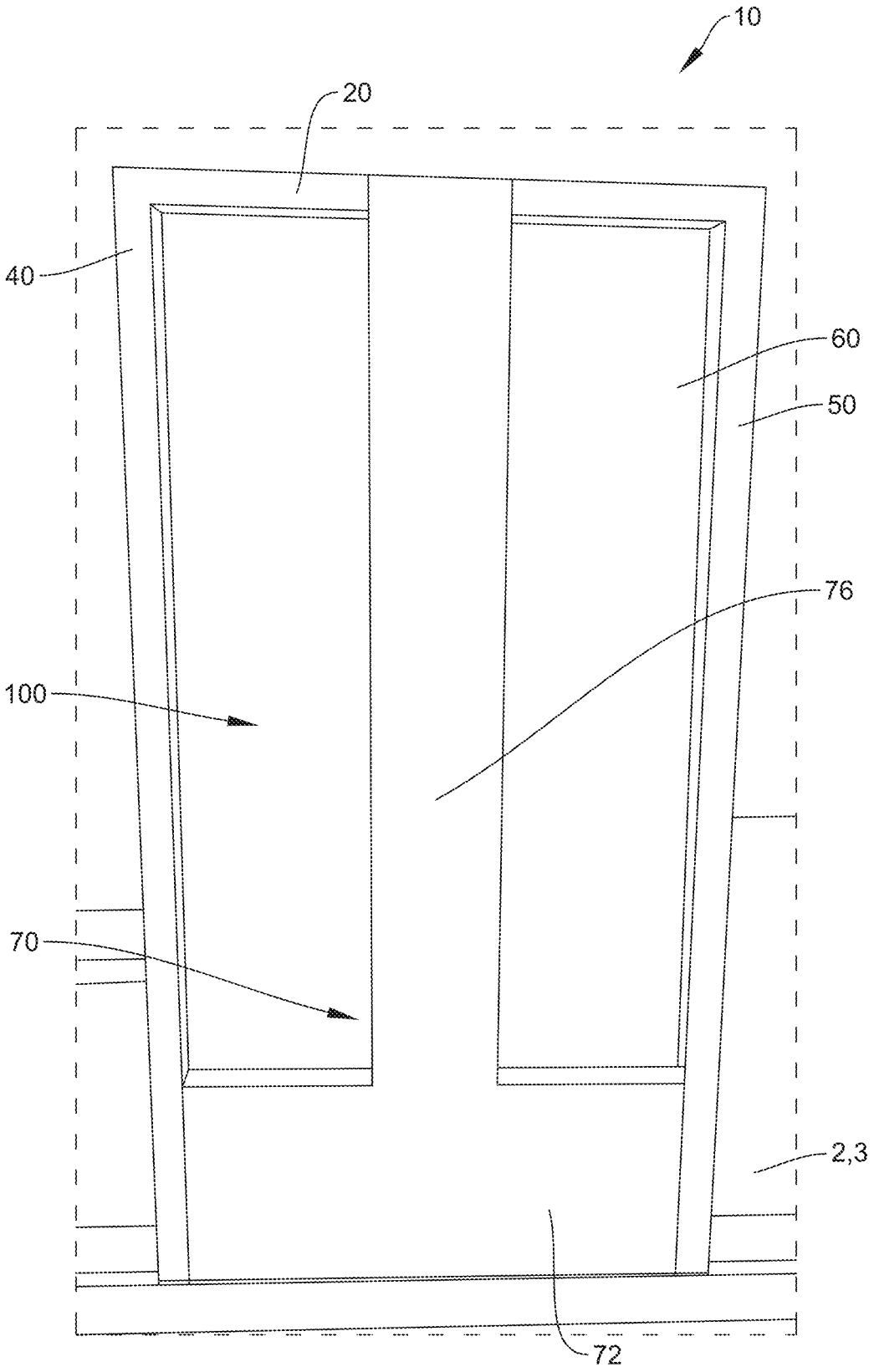
FIG. 1 is a front elevational view of the container, in accordance to one embodiment of the present invention.
Figure 3:
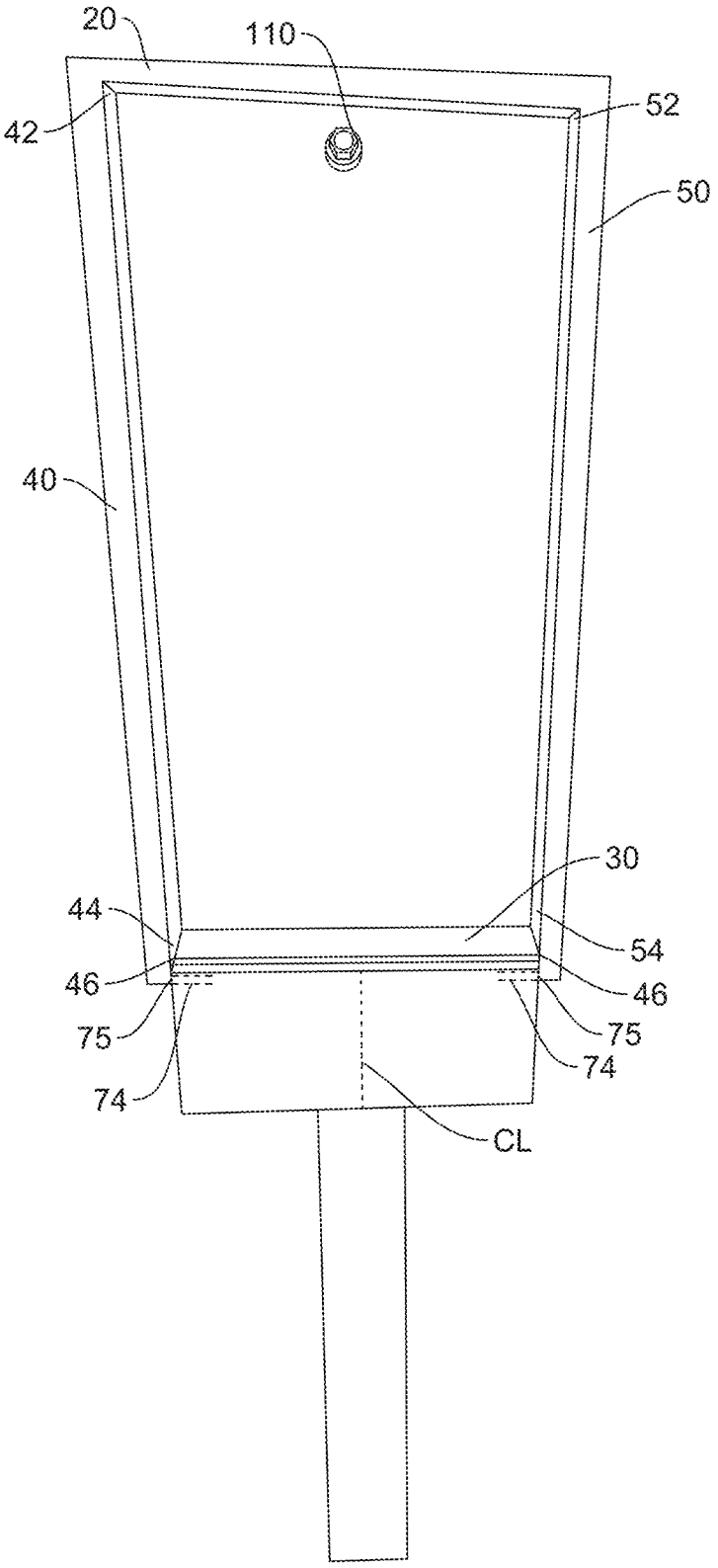
FIG. 3 is a front elevational view of the container showing the front door in a fully opened position, in accordance to one embodiment of the present invention.
Figure 4:
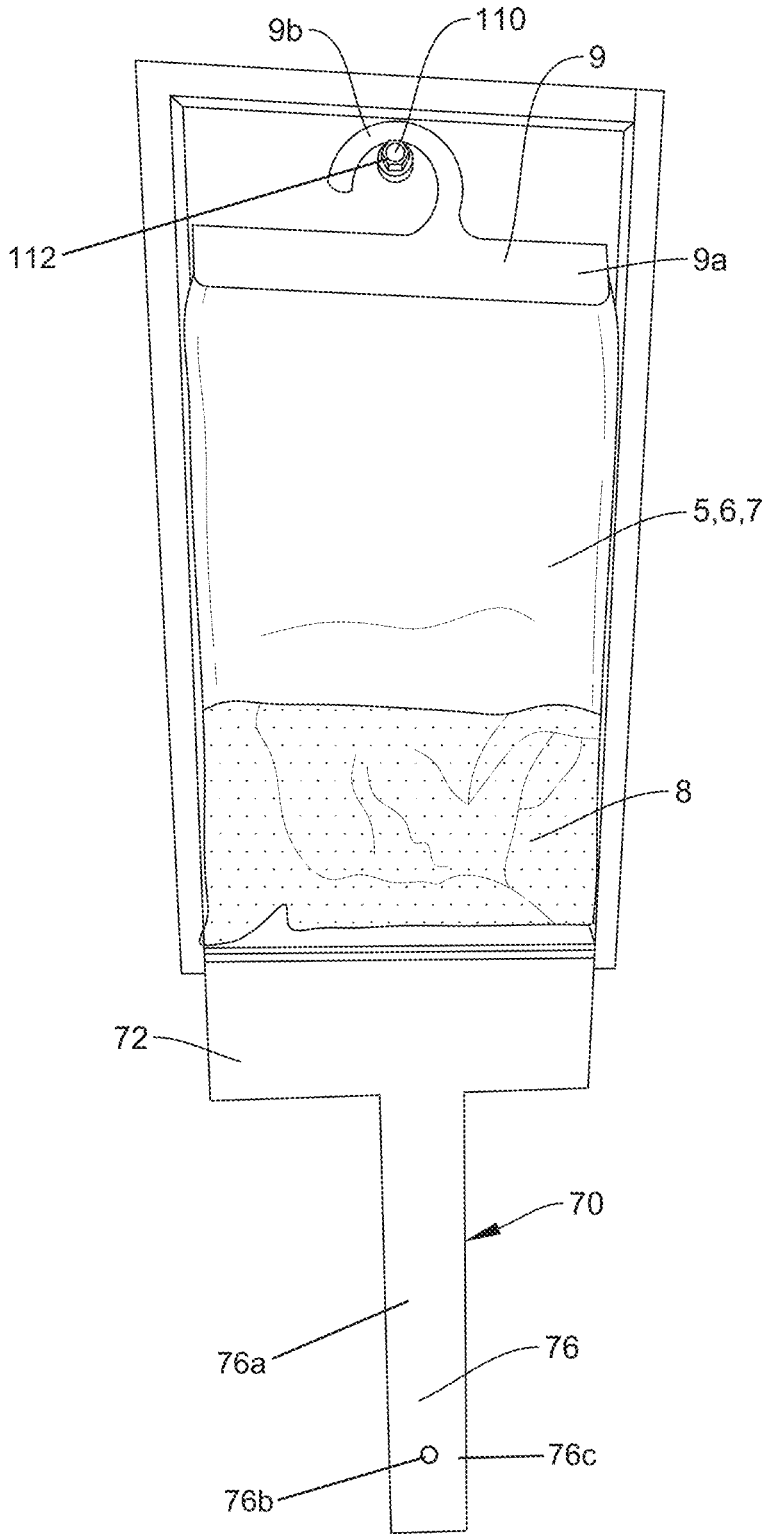
FIG. 4 is a front elevational view of the container illustrating a moisture absorbing pouch contained therein in a supported manner, the container shown with the front door thereof in a fully opened position.
Figure 5:
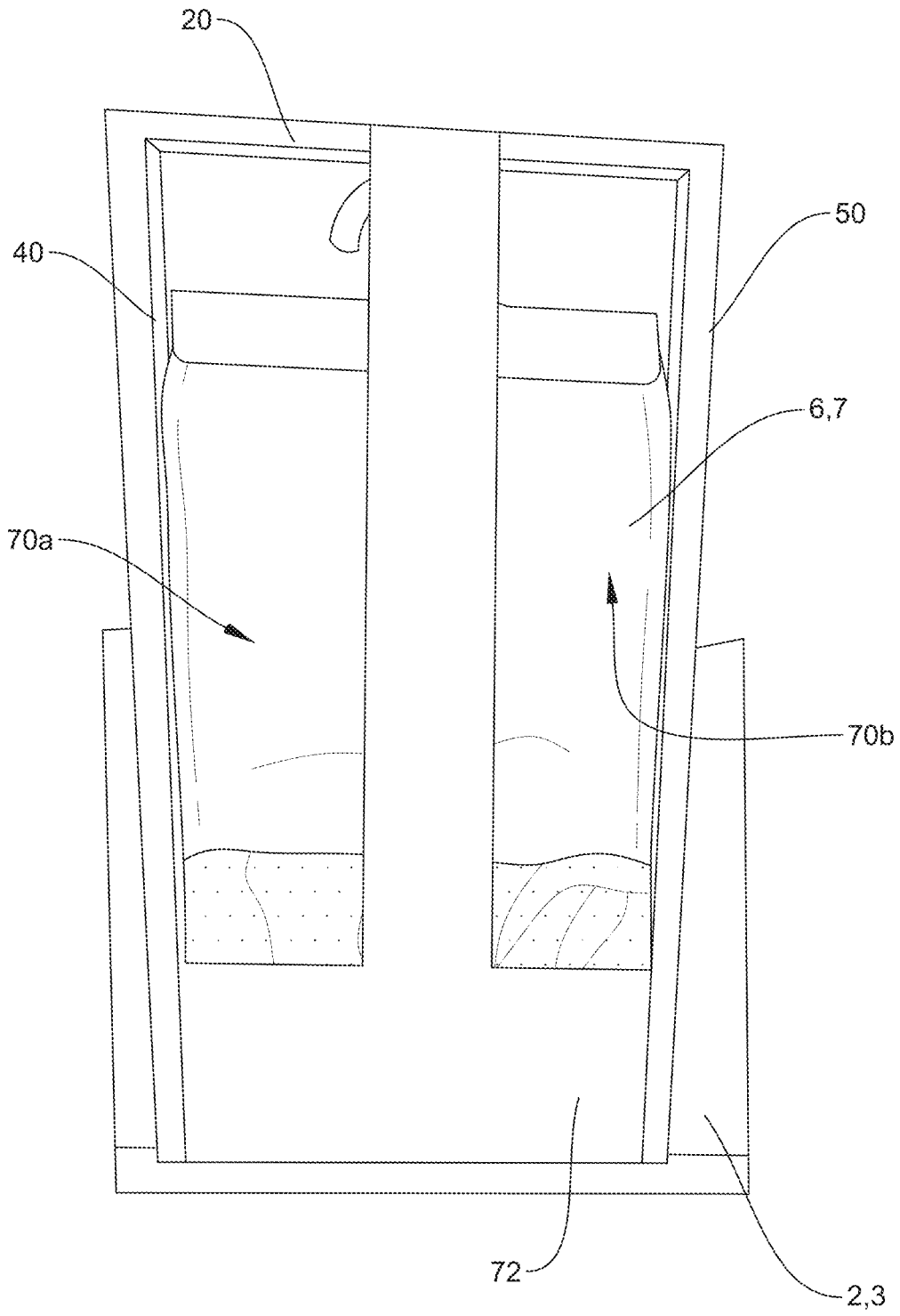
FIG. 5 is a front elevational view of the container illustrating the moisture absorbing pouch contained therein in a supported manner, the container shown with the front door thereof in a closed, locked position.

A spring-loaded pin 80 is disposed within a bore 74 defined in lower opposed ends of the lower panel 72 of the front door 70. The bore 74 has an outer opening 75 in open, fluid communication with the bore 74. Each piston 86 projects outward horizontally from the outer opening 75 and is slidably received within a respective piston receiving slot 46 horizontally defined within the lower end inner surfaces 44 and 54 of the first vertical wall 40 and second vertical wall 50, respectively. The spring-loaded pins 80 enable the front door 70 to pivot in a frictionless manner to both a fully opened position, as best shown in FIGS. 3 and 4, and to a closed position, as best shown in FIGS. 1 and 5. The front door 70 may also be positioned in a closed, locked position via a means 90 for releasably securing, or otherwise fastening or locking, the door 70 in a closed position. The means 90 for releasably securing the door 70 in a closed position includes, but is not limited to, singularly or in combination, a toggle latch 92, a spring claw latch, a draw latch, hook-and-loop fasteners, buttons, studs, hooks, eyelets, buckles, snap fasteners, magnets, grommets, and other complementary type or matching connector devices and systems.

Figure 6:
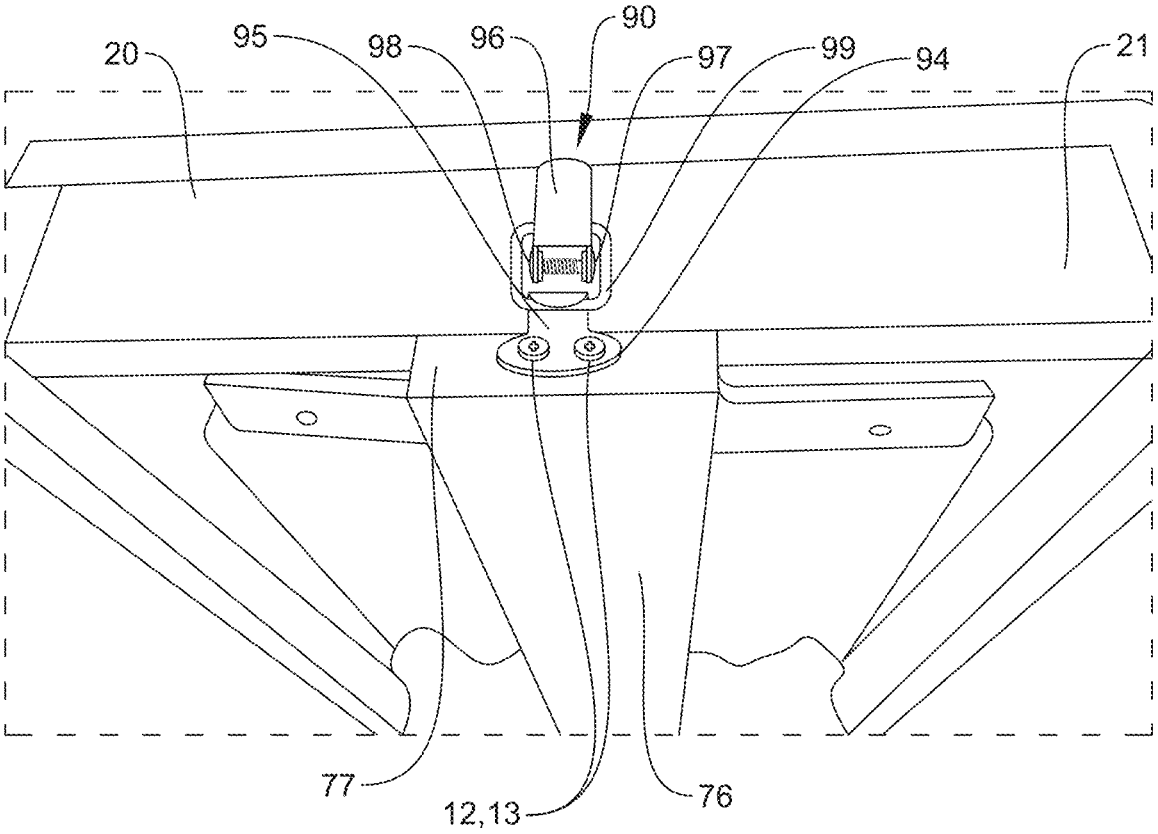
FIG. 6 is a partial top perspective view of the container in FIG. 5 illustrating a means for releasably securing the front door in a closed position, said means depicted in the form of a toggle latch.

Referring now more particularly to FIG. 6, in accordance to one embodiment, the means 90 for releasably securing the front door 70 in a closed, locked position comprises a toggle latch 92. The toggle latch 92 comprises a catch bracket 94, a lever 96 pivotally coupled to a pivot member 97, and a hook latch 99. The pivot member 97 may be a spring-biased pivot member 97 comprising a spring 98. The catch bracket 94 is mounted via fasteners 12, such as screws 13, superjacent an upper end 77 of the arm 76 of the front door 70. The catch bracket 94 includes an incurvate tongue 95 for engagement by the hook latch 99. The pivot member 97 is mounted superjacent an upper end 21 of the top wall 20. The lever 96 is pivoted forwardly to the catch bracket 94 so as facilitate engagement by the hook latch 99 with the incurvate tongue 95 of bracket 94. Once the hook latch 99 engages incurvate tongue 95, the lever 96 is pivoted rearwardly, thereby releasably securing the front door 70 in a closed, locked position, as best depicted in FIGS. 1, 5, and 6. To release the front door 70, the lever 96 is pivoted forwardly until the hook latch 99 releases engagement from the incurvate tongue 95 of the catch bracket 94.

In reference to FIGS. 3-5, an article suspension post 110 is mounted to the rear wall 60 about an upper, central margin thereof. The post 110 provides a support means on which a commercially-available moisture absorbing pouch 6 or bag may be hung, thereby supporting the pouch 6 in an immobilized, vertically-suspended manner within an interior storage volume 100 (as further described hereinbelow) of the container 10.

Referring now more particularly to FIGS. 1, 3, 4, and 5, when the front door 70 is oriented to a closed, locked position, the container 10 provides an interior storage volume 100 dimensionally configured to accommodate a disposable moisture absorbing article 5 (e.g., a commercially-available moisture absorbing pouch 6 or bag) in a snug, size matching or complementary-fit manner. In addition, when the front door 70 is closed, the enlarged openings 70*a*, 70*b* on opposed sides of the narrow arm 76 are in open fluid communication with the interior storage volume 100, thereby allowing open access to ambient air, ambient room air, and non-forced air by the pouch 6, and thus enabling optimal operation thereof as designed.

Further, a circular bore 76*b* is disposed perpendicularly along an upper margin 76*c* of the interior surface 76*a* of the arm 76 of the front door 70. When the front door 70 is oriented to a closed position, the bore 76*b* is linearly aligned with the post 110, and a tip 112 of the post 110 is slidably received within the bore 76*b*. The positioning of the tip 112 of the post 110 in the bore 76*b* enhances the structural integrity of the post 110, such as when a downward pull or gravitational force is exerted on the post 110 by the pouch 6 during periods in which the container 10 moves vertically or in an undulating fashion when container 10 is mounted to a mobilized vehicle or vessel, particularly a boat, as it undulates across waves of a body of water.

Figure 2:
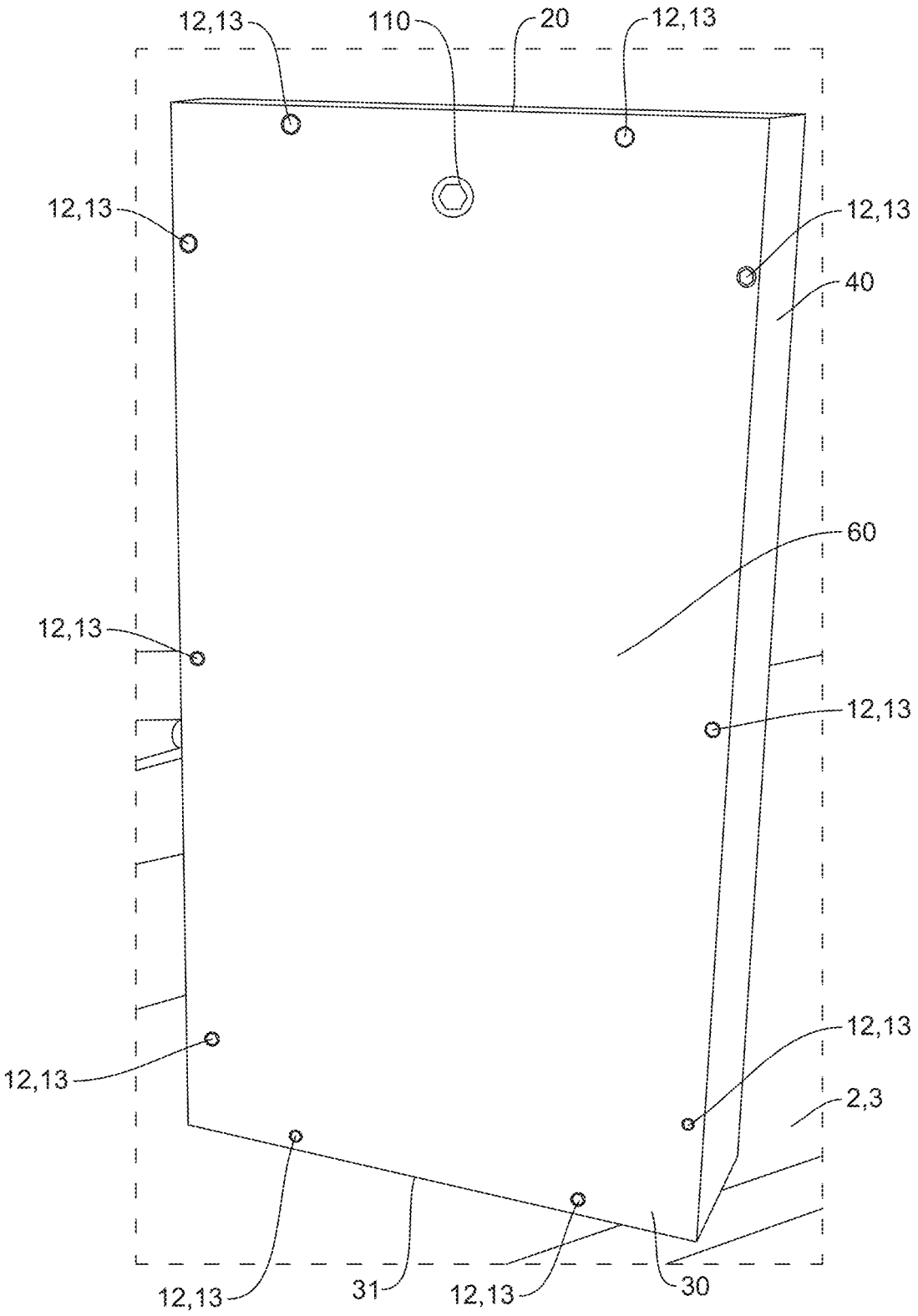
FIG. 2 is a right, rear elevational view of the container of FIG. 1.

Significantly, as best depicted in FIG. 2, the bottom wall 30 provides a flat base 31 enabling the container 10 to stand atop a flat, horizontal surface 2 (e.g., shelf top, countertop, or table top 3), in an upright orientation, absent or independent any other means of support, stability, or assistance, thereby preventing spillage of the contents 8 from the article 5 (pouch 6) during the period in which the pouch 6 is hung in the interior storage volume 100 of the container 10. In accordance to one embodiment, the commercially-available moisture absorbing pouch 6 comprises a moisture absorbing pouch 7 sold under the registered trademark, "DampRid®". The moisture absorbing pouch 7 comprises contents 8 which may include chemical dehumidifying preparations, namely, gels and powdered or flaked solids in the nature of desiccants for absorbing moisture in enclosed areas, and in preventing the growth of mold and mildew, air deodorizing preparations for deodorizing ambient and non-forced air, and air purifying preparations for purifying ambient and non-forced air. The moisture absorbing pouch 7 further comprises a hanger portion 9 comprising a linearly-elongated body 9*a* from which a hook 9*b* extends integrally upward therefrom.

Finally, in reference to FIGS. 9-9*a*, the rear surface 61 of the rear wall 60 may comprise mounting hardware 120 securably fastened thereto in order to enable the container 10 to be securably hung on a vertical surface VS, such as a wall W. Mounting hardware 120 may include, but is not limited to, a wall hook, cleat hanger, U-shaped bracket, D-ring hanger, sawtooth hanger, bolts and washers 122, and the like, for enabling mounting of the container 10 onto a vertical surface VS, such as a wall W.

Preferably, in reference to FIGS. 10-10*b*, a plurality of recessed apertures 130 are spatially defined through the rear wall 60. The plurality of recessed apertures 130 is adapted and configured to enable the container 10 (particularly, the rear wall 60 portion thereof) to be securably hung in a flush and stable manner superjacent a vertical surface VS, such as a wall W, vertical beam VB or stud, and/or a horizontal surface HS, such as a horizontal beam HB. Being able to hang the container 10 securably in a flush and stabilized manner against a vertical surface and/or a horizontal surface imparts significant functional advantages when said container 10 is mounted to a vertical surface VS and/or a horizontal surface HS to or inside a motorized vehicle, vessel, or boat. The flush and secured mounting of the container 10 stabilizes the container, and thus the moisture absorbing article 5 or pouch 6 positioned therein, thereby preventing spillage of the contents 8 from the article 5 (pouch 6) during the period in which the pouch 6 is hung in the interior storage volume 100 of the container 10 while the motor vehicle or boat is mobile.

In accordance to one embodiment, the plurality of recessed apertures 130 comprises four in number. A first recessed aperture 131 is defined along an upper, center margin of the rear wall 60, and a second recessed aperture 132 is defined along a lower, center margin of the rear wall 60, wherein the first recessed aperture 131 and the second recessed aperture 132 are linearly aligned. A third recessed aperture 133 is defined adjacent a right side edge of the rear wall 60 and oriented mesial to the first and second recessed apertures 131 and 132. A fourth recessed aperture 134 is defined adjacent a left side edge of the rear wall 60, oriented mesial to the first and second recessed apertures 131 and 132, and aligned linearly to the third recessed aperture 133.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A container for an article, the container comprises:

a top wall opposing a bottom wall;

a first vertical wall opposing a second vertical wall;

a rear wall contiguous to the top wall, the bottom wall, the first vertical wall, and the second vertical wall;

a front door pivotally secured between the first vertical wall and the second vertical wall, the front door pivots to a fully opened position and to a closed position, wherein the front door comprises a T-shaped configuration having a horizontal lower panel and an elongated, narrow arm integrally projecting from the horizontal lower panel about a centerline thereof, thereby forming enlarged openings on opposed sides of the narrow arm;

an interior storage volume dimensionally configured to accommodate a disposable moisture absorbing article in a snug-fit manner;

an article suspension post mounted to the rear wall about an upper, central margin thereof, the article suspension post providing a support means on which the disposable moisture absorbing article is hung, thereby supporting the disposable moisture absorbing article in an immobilized, vertically-suspended manner within the interior storage volume of the container, and wherein the article suspension post comprises a tip, the tip is slidably received within a bore disposed perpendicularly along an upper margin of an interior surface of the arm of the front door when the front door is oriented to a closed position; and a means for releasably securing the front door in a closed, locked position.

2. The container of claim 1, wherein the disposable moisture absorbing article comprises a moisture absorbing pouch.

3. The container of claim 1, wherein the enlarged openings of the front door are in open fluid communication with the interior storage volume, thereby allowing open access to ambient air, ambient room air, and non-forced air by the disposable moisture absorbing article.

4. The container of claim 1, wherein the front door is pivotally secured between the first vertical wall and the second vertical wall via a pair of spring-loaded pins, the spring-loaded pins enabling the front door to pivot in a frictionless manner to a fully opened and closed position.

5. The container of claim 1, wherein the means for releasably securing the front door in a closed, locked position comprises a toggle latch.

6. The container of claim 1, further comprising a plurality of recessed apertures spatially defined through the rear wall, wherein the plurality of recessed apertures enabling the container to be securably mounted in a stabilized and flush manner superjacent at least one of a vertical surface and a horizontal surface.

7. The container of claim 2, wherein the bottom wall comprises a flat base enabling the container to stand atop a flat, horizontal surface in an upright orientation, independent any other means of support, stability, or assistance, thereby preventing spillage of contents from the moisture absorbing pouch during a period in which the pouch is hung in the interior storage volume of the container.

* * * * *